US011141620B2

(12) United States Patent
Robinson

(10) Patent No.: US 11,141,620 B2
(45) Date of Patent: Oct. 12, 2021

(54) SEATED EXERCISE DEVICE

(71) Applicant: 1195143 B.C. LTD., White Rock (CA)

(72) Inventor: Brian Robinson, Sherbrooke (CA)

(73) Assignee: 1195143 B.C. LTD., Langley (CA)

( * ) Notice: Subject to any disclaimer, the term of this patent is extended or adjusted under 35 U.S.C. 154(b) by 52 days.

(21) Appl. No.: 16/611,523

(22) PCT Filed: May 8, 2018

(86) PCT No.: PCT/CA2018/050543
§ 371 (c)(1),
(2) Date: Nov. 7, 2019

(87) PCT Pub. No.: WO2018/205018
PCT Pub. Date: Nov. 15, 2018

(65) Prior Publication Data

US 2020/0108287 A1 Apr. 9, 2020

Related U.S. Application Data

(60) Provisional application No. 62/646,516, filed on Mar. 22, 2018, provisional application No. 62/502,812, filed on May 8, 2017.

(51) Int. Cl.
*A63B 21/055* (2006.01)
*A63B 22/20* (2006.01)
(Continued)

(52) U.S. Cl.
CPC ..... *A63B 21/0552* (2013.01); *A63B 21/02* (2013.01); *A63B 22/0087* (2013.01);
(Continued)

(58) Field of Classification Search
CPC ..... A63B 21/00058; A63B 21/00065; A63B 21/02; A63B 21/0407; A63B 21/0428;
(Continued)

(56) References Cited

U.S. PATENT DOCUMENTS 254,108 A 2/1882 Bryon
1,633,124 A * 6/1927 Noe ..... A63B 21/0552 482/126
(Continued)

FOREIGN PATENT DOCUMENTS

CA 1284666 C 6/1991
CN 106218788 A 12/2016

OTHER PUBLICATIONS

Search Report and Written Opinion dated Aug. 6, 2018 for International Application No. PCT/CA2018/050543.
(Continued)

*Primary Examiner* — Megan Anderson
*Assistant Examiner* — Kathleen Vermillera
(74) *Attorney, Agent, or Firm* — Norton Rose Fulbright Canada LLP

(57) ABSTRACT

A seated exercise unit includes a base raised from a floor and supported thereby. The base extends between a first end and an opposed second end. A resistance-generating assembly includes a stationary band anchor attached to the base. The resistance-generating assembly includes a displaceable seat member removably mounted to the base and displaceable therealong between the first and second ends of the base. The seat member has a displaceable band anchor spaced apart from the stationary band anchor and displaceable with the seat member relative to the stationary band anchor. At least one resilient band is mountable to the stationary and displaceable band anchors and extends therebetween. The at least one resilient band generates resistance upon being elastically deformed by displacement of the displaceable band anchor relative to the stationary band anchor.

24 Claims, 6 Drawing Sheets

(51) Int. Cl.
*A63B 23/02* (2006.01)
*A63B 21/02* (2006.01)
*A63B 22/00* (2006.01)

(52) U.S. Cl.
CPC ..... *A63B 22/0089* (2013.01); *A63B 22/203* (2013.01); *A63B 23/0205* (2013.01)

(58) Field of Classification Search
CPC ..... A63B 21/0442; A63B 21/055; A63B 21/0552; A63B 21/0555; A63B 21/0557; A63B 21/4045; A63B 22/0087; A63B 22/0089; A63B 22/20; A63B 22/201; A63B 22/203; A63B 21/0076; A63B 21/00; A63B 23/0205; A63B 23/02
See application file for complete search history.

(56) References Cited

U.S. PATENT DOCUMENTS 1,729,399 A * 9/1929 Noe ..... A63B 21/00043 482/126
1,749,544 A * 3/1930 Pagano ..... A63B 21/00043 482/126
1,980,036 A * 11/1934 Casler ..... A63B 69/06 482/72
3,863,521 A 2/1975 Gatsos
3,958,803 A 5/1976 Geisselbrecht
4,072,309 A 2/1978 Wilson
4,492,375 A 1/1985 Connelly
4,582,320 A 4/1986 Shaw
4,621,805 A 11/1986 Chen
4,685,670 A 8/1987 Zinkin
5,029,850 A 7/1991 Van Straaten
5,050,869 A 9/1991 Frate
5,135,216 A 8/1992 Bingham et al.
5,144,859 A 9/1992 Malone
5,242,353 A 9/1993 Cole et al.
5,334,122 A 8/1994 Cole et al.
5,387,171 A 2/1995 Casey et al.
5,468,205 A 11/1995 McFall et al.
5,603,681 A 2/1997 Olschansky et al.
5,616,111 A 4/1997 Randolph
5,722,922 A 3/1998 Watterson et al.
5,820,529 A 10/1998 Weintraub
6,015,371 A 1/2000 Davitt
6,042,523 A * 3/2000 Graham ..... A63B 21/0552 482/121
6,071,217 A * 6/2000 Barnett ..... A63B 21/0552 482/121
6,142,919 A 11/2000 Jorgensen
6,319,179 B1 11/2001 Hinds
6,494,817 B2 12/2002 Lake
6,527,685 B2 * 3/2003 Endelman ..... A63B 21/023 482/121
6,669,609 B2 12/2003 Gerschefske et al.
6,939,278 B2 * 9/2005 Atwell ..... A63B 17/04 482/121
7,163,500 B2 1/2007 Endelman et al.
7,931,570 B2 * 4/2011 Hoffman ..... A63B 21/055 482/123
8,485,950 B2 7/2013 Adams
8,562,492 B2 * 10/2013 Gerschefske ..... A63B 23/0405 482/95
9,005,086 B1 4/2015 O'Neil
9,028,381 B2 5/2015 Mestemaker
2001/0056011 A1 * 12/2001 Endelman ..... A63B 22/0087 482/121
2011/0143894 A1 6/2011 Castel
2012/0142503 A1 6/2012 Sevadjian et al.
2014/0069475 A1 3/2014 Lenhart
2014/0141948 A1 5/2014 Aronson et al.
2015/0133276 A1 5/2015 Kaye et al.
2016/0074691 A1 3/2016 Pearce et al.
2017/0014667 A1 * 1/2017 Barnett ..... A63B 23/03525
2019/0192895 A1 * 6/2019 Corrigan ..... A63B 21/0428

OTHER PUBLICATIONS

Written Opinion dated Aug. 13, 2019 for Singapore Patent Application No. 11201807424V.
International Search Report and the Written Opinion dated Nov. 2, 2017.

* cited by examiner

SEATED EXERCISE DEVICE

CROSS REFERENCE TO RELATED APPLICATIONS

This application is 371 patent application of PCT/CA2018/050543, which claims priority to U.S. provisional patent application No. 62/502,812 filed May 8, 2017, and to U.S. provisional patent application No. 62/646,516 filed Mar. 22, 2018, the entire contents of all of which are incorporated by reference herein.

TECHNICAL FIELD

The application relates generally to exercise devices, and more particularly, to a seated exercise device.

BACKGROUND

Various devices exist for performing resistance or load-bearing exercises. Some of these devices may be used in a non-gym facility, such as in the home or in a hotel room.

Effective weight-training requires continuously increasing the resistance or load. Many gyms are restricted in the amount of resistance that can be added, which limits their usefulness.

SUMMARY

In an aspect, there is provided a seated exercise unit, comprising: a base raised from a floor and supported thereby, the base extending between a first end and an opposed second end; a displaceable seat member removably mounted to the base and displaceable therealong between the first and second ends of the base; and a resistance-generating assembly, comprising: a stationary band anchor attached to the base; a displaceable band anchor attached to the seat member, the displaceable band anchor being spaced apart from the stationary band anchor and displaceable with the seat member relative to the stationary band anchor; and at least one resilient band mountable to the stationary and displaceable band anchors and extending therebetween, the at least one resilient band generating resistance upon being elastically deformed by displacement of the displaceable band anchor relative to the stationary band anchor.

In an embodiment, the at least one resilient band includes a plurality of resilient bands being stackable one on top of the other to form a stack of resilient bands, the stack of resilient bands generating resistance upon each resilient band in the stack of resilient bands being elastically deformed by displacement of the displaceable band anchor relative to the stationary band anchor.

In an embodiment, a first resilient band in the stack of resilient bands is removably mountable to the stationary and displaceable band anchors to extend therebetween, each of the other resilient bands in the stack of resilient bands being removably mountable to another one of the resilient bands.

In an embodiment, the stationary and band anchors are disposed in a groove of the base.

In an embodiment, the groove is disposed along a center line of the base.

In an embodiment, the at least one resilient band includes an elongated resilient body having opposed ends, a first mounting member attached to the resilient body at one of the ends, and a second mounting member attached to the other end of the resilient body, the first and second mounting members being made of an inelastic material, the first mounting member being removably mountable to the stationary band anchor and the second mounting member being removably mountable to the displaceable band anchor.

In an embodiment, at least one of the first mounting member, the second mounting member, and the resilient body have a visual indicia indicative of a resistance of the at least one resilient band.

In an embodiment, the base has at least one leg extending to the floor, a length of the leg being adjustable.

In an embodiment, the at least one resilient band generates a tension force upon being elastically deformed by displacement of the displaceable band anchor relative to the stationary band anchor in a first direction, and generates a contraction force acting in a second direction opposite to the first direction upon the at least one resilient band, in an elastically-deformed position, being released therefreom.

In an embodiment, the base includes a mounting member at the first end thereof, the mounting member extending from the base to a distal end of the mounting member, the distal end of the mounting member defining a pivot.

In another aspect, there is provided a seated exercise unit, comprising: a base raised from a floor and supported thereby, the base having a track with a groove extending along a length of the track between a first end and an opposed second end of the base; a seat member having a seating portion and a seat bracket positioned on an underside of the seating portion, the seat bracket displaceably mounted in the groove of the track to displace the seating portion relative to the track along the length thereof; and a resistance-generating assembly, comprising: a stationary band anchor attached to the track; a displaceable band anchor attached to the seating portion or to the seat bracket, the displaceable band anchor being displaceable with the seating portion and relative to the stationary band anchor; and at least one resilient band positionable within the groove of the track and removably mountable to the stationary and displaceable band anchors and extending therebetween, the at least one resilient band generating resistance upon being elastically deformed by displacement of the displaceable band anchor relative to the stationary band anchor.

In an embodiment, the at least one resilient band includes a plurality of resilient bands being vertically stackable one on top of the other within the groove to form a stack of resilient bands, the stack of resilient bands generating resistance upon each resilient band in the stack of resilient bands being elastically deformed by displacement of the displaceable band anchor relative to the stationary band anchor.

In an embodiment, a lowermost resilient band in the stack of resilient bands is removably mountable to the stationary and displaceable band anchors to extend therebetween, each of the other resilient bands in the stack of resilient bands being removably mounted to the resilient band disposed immediately underneath.

In an embodiment, the stationary and band anchors are disposed in the groove of the track.

In an embodiment, the groove is disposed along a center line of the track.

In an embodiment, the at least one resilient band includes an elongated resilient body having opposed ends, a first mounting member attached to the resilient body at one of the ends, and a second mounting member attached to the other end of the resilient body, the first and second mounting members being made of an inelastic material, the first mounting member being removably mountable to the stationary band anchor and the second mounting member being removably mountable to the displaceable band anchor.

In an embodiment, at least one of the first mounting member, the second mounting member, and the resilient body have a visual indicia indicative of a resistance of the at least one resilient band.

In an embodiment, the base has at least one leg extending to the floor, a length of the leg being adjustable.

In an embodiment, the at least one resilient band generates a tension force upon being elastically deformed by displacement of the displaceable band anchor relative to the stationary band anchor in a first direction, and generates a contraction force acting in a second direction opposite to the first direction upon the at least one resilient band, in an elastically-deformed position, being released therefreom.

In an embodiment, the base includes a mounting member at the first end thereof, the mounting member extending from the base to a distal end of the mounting member, the distal end of the mounting member defining a pivot.

In yet another aspect, there is provided a method of generating resistance, comprising: connecting one end of at least one resilient band to a stationary first structure; connecting another end of the at least on resilient band to a displaceable seat member; and displacing the seat member relative to the stationary first structure to elastically deform the at least one resilient band to generate resistance.

In an embodiment, connecting one end of the at least one resilient band includes connecting multiple resilient bands together to form a stack of resilient bands, a resistance of the stack being greater than a resistance of any one of the resilient bodies alone.

In an embodiment, displacing the seat member includes generating a tension force upon the at least one resilient band being elastically deformed by displacement of the seat member relative to the stationary first structure in a first direction, and generating a contraction force acting in a second direction opposite to the first direction when the at least one resilient band, in an elastically-deformed position, is released therefreom.

In an embodiment, displacing the seat member includes displacing the seat member in a substantially horizontal plane.

DESCRIPTION OF THE DRAWINGS

Reference is now made to the accompanying figures in which.

DETAILED DESCRIPTION

Figure 1A:
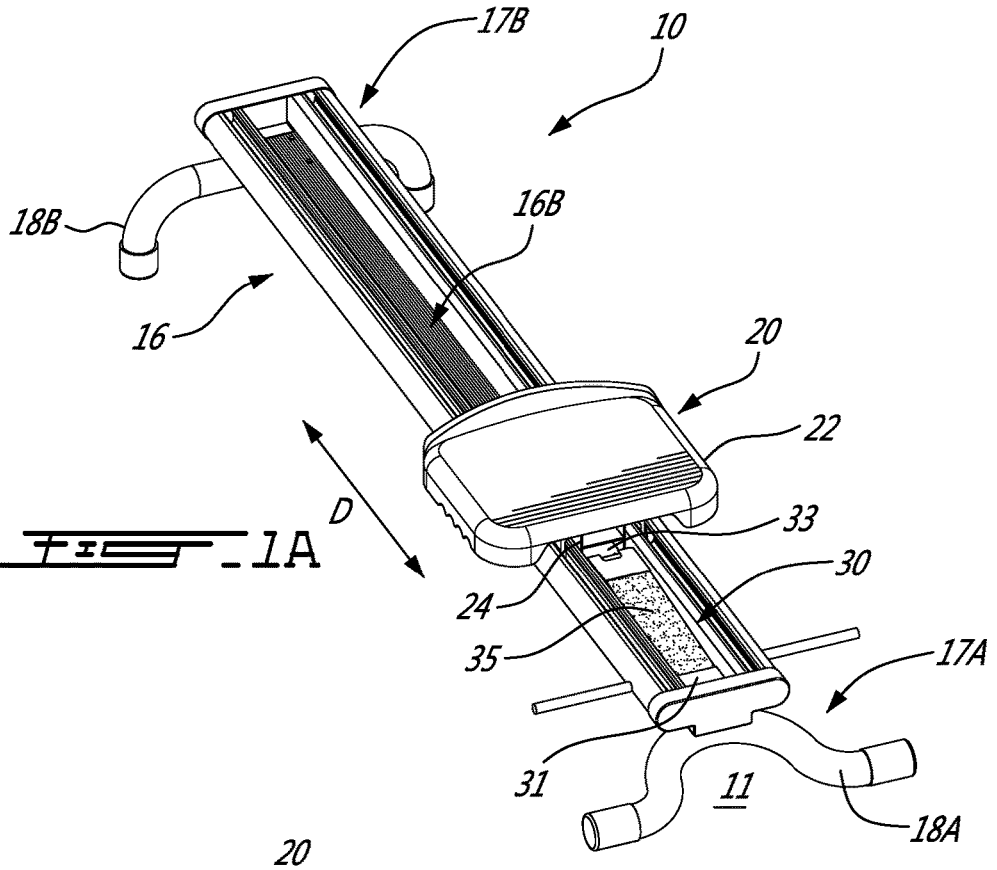
FIG. 1A is a perspective view of a seated exercise unit, according to an embodiment of the present disclosure.
Figure 1B:
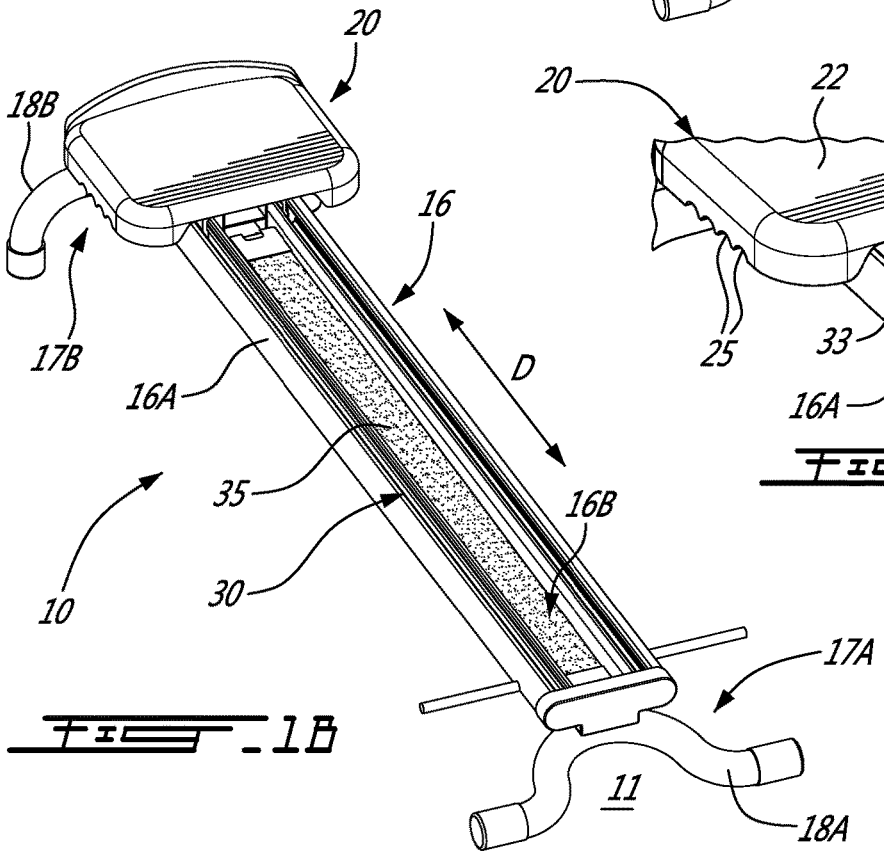
FIG. 1B is another perspective view of the seated exercise unit of FIG. 1A, a resilient band being shown elastically deformed.
Figure 1C:
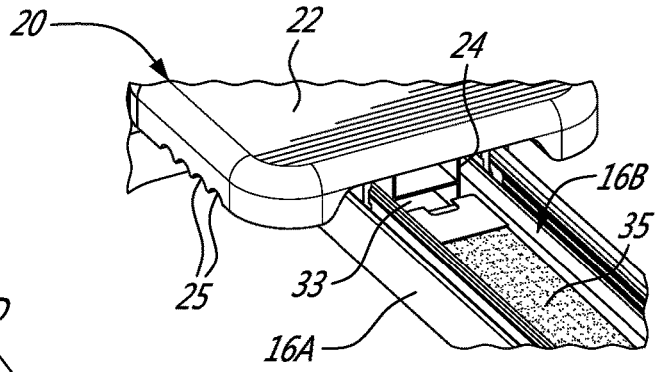
FIG. 1C is an enlarged view of the seated exercise unit of FIG. 1A showing the resilient band mounted to a seat member.

FIGS. 1A to 1C illustrate a seated exercise unit 10. The seated exercise unit 10 can be used by one or more individuals for resistance exercises as part of a cardiovascular or weight-training regimen. As will be explained below, embodiments of the seated exercise unit 10 allow for it to be disassembled and stored for easy transportation. The seated exercise unit 10 can also be mounted to, and removed from, a support surface for storage. The seated exercise unit 10 (or simply "unit 10") can thus be used for resistance exercises, and can be quickly deployed in any suitable room.

The unit 10 is intended to be used by the user when s/he is in a seated position. In the depicted embodiment, the user sits on a component of the unit 10 to perform resistance exercises thereon. The unit 10 includes an elongated base 16 that extends along a floor surface 11. A seat member 20 for receiving the user of the unit 10 thereon is mounted on the base 16 and displaceable therealong. The unit 10 also has a resistance-generating assembly 30 which cooperates with the seat member 20 and with the base 16 to provide the desired resistance for the resistance exercises. Although shown in FIG. 1A in its assembled form, the unit 10 can be provided as a kit of disassembled parts, which includes one or more components of the unit 10.

The base 16 extends between a first end 17A and a second end 17B. The base 16 includes first and second legs 18A, 18B at its corresponding first and second ends 17A,17B which raise the base 16 and the entire unit 10 from the floor surface 11 upon which the unit 10 rests. The base 16 also provides the requisite load-bearing capability to the unit 10, and allows the unit 10 to resist the loads and forces generated when the unit 10 is being used. One or both of the first and second legs 18A,18B are adjustable to raise and lower the seat member 20 from the floor surface 11. This adjustability allows one of the first and second legs 18A,18B to be raised more than the other so that the unit 10 is inclined relative to the floor surface 11. Other configurations for the base 16 are within the scope of the present disclosure. The base 16 forms the corpus of the unit 10 and provides structure thereto.

In the embodiment shown in FIGS. 1A to 1C, the base 16 includes a track 16A raised from the floor surface 11 by the first and second legs 18A,18B. The track 16A is an aluminum or plastic extrusion that defines a groove 16B aligned with a center line of the track 16A. The groove 16B is defined by interconnected walls of the track 16A including substantially upright side walls which delimit the lateral extent of the groove 16B, and a bottom wall which delimits the floor of the groove 16B. The groove 16B extends along substantially the entire length of the track 16A in the depicted embodiment. In an alternate embodiment, the groove 16B extends along only some of the length of the track 16A.

The seat member 20 provides a platform on which the user can sit. It is mounted to, and removable from, the base 16. The seat member 20 is displaceable along some or all of the length of the base 16, between its first and second ends 17A,17B. More particularly, and as shown, the seat member 20 is slidingly displaceable along the base 16 in the direction D. As will be explained in greater detail below, the user causes the displacement of the seat member 20 by performing the resistance exercises.

In the depicted embodiment of the unit 10, the seat member 20 is mounted on the track 16A to slide therealong. The seat member 20 has a seating portion 22 which supports the user sitting thereon, and a seat bracket 24 positioned and mounted to an underside of the seating portion 22. The seat bracket 24 links the seating portion 22 to the track 16A. More particularly, and as better shown in FIG. 1C, the seat bracket 24 is mounted to the track 16A to be located within the groove 16B of the track 16A such that the seating portion 22 is able to slide relative to the track 16A along its length. The seat bracket 24 has wheels 26 (see FIG. 4C) which engage a part of the track 16A to displace the seat member 20 therealong.

Still referring to FIGS. 1A to 1C, the resistance-generated assembly 30 (sometimes referred to herein as simply "assembly 30") allows the user to increase and decrease the resistance as needed. As will be explained in greater detail below, scaling the resistance up or down can be easily performed, and does not require the use of relatively heavy free weights to do so.

The assembly 30 includes a stationary band anchor 31 that is fixed to the base 16, at any suitable portion thereon. In the depicted embodiment, the stationary band anchor 31 is fixed to the track 16A. The stationary band anchor 31 is a fixed component, and is not displaceable relative to the seat member 20 or to the base 16. It engages with one or more resistance elements, as described in greater detail below. It can therefore take any suitable form. In the embodiment of FIGS. 1A to 1C, and as better shown in FIGS. 2A and 2B, the stationary band anchor 31 includes a base portion 31A secured against the bottom wall of the groove 16B of the track 16A. A bracket 31B having a female receiving portion 31C is configured to receive a male portion of the resistance element, as described in greater detail below. Other configurations for the stationary band anchor 31 are possible. For example, the stationary band anchor 31 can have one or more hooks for receiving the resistance elements. In another example, the stationary band anchor 31 can be attached to, and removed from, the base 16 provided that once attached, the stationary band anchor 31 remains fixed in place. The assembly 30 can have multiple stationary band anchors 31, each being attached to the base 16, and having different configurations (e.g. extending vertically from the base 16 at the first end 17A, multiple stationary band anchors 31 extending horizontally outward from both sides of the base 16 and spaced apart along part of the length of the base 16, etc.). One or more of the stationary band anchors 31 can be manipulated by the user to change its orientation, thereby changing the direction of resistance generated by the resistance elements.

The assembly 30 also has a displaceable band anchor 33. Similarly to the stationary band anchor 31, the displaceable band anchor 33 engages with one or more resistance elements and helps to generate resistance. The displaceable band anchor 33 is attached to the seat member 20 and is thus displaced with the seat member 20 relative to the stationary band anchor 31. The displaceable band anchor 33 is spaced apart from the stationary band anchor 31 and is displaceable relative thereto (i.e. towards and away from the stationary band anchor 31 in the direction D), which allows the resistance elements to be used to generate resistance. In the depicted embodiment, resistance is generated when the displaceable band anchor 33 is displaced away from the stationary band anchor 31. Similarly to the stationary band anchor 31, the displaceable band anchor 33 can take any suitable form capable of such functionality. For example, and similarly to the stationary band anchor 31, the displaceable band anchor 33 includes a bracket, attached to or part of the seat bracket 24 of the seat member 20, that has a female receiving portion configured to receive a male portion of the resistance element. In another example, the displaceable band anchor 33 can have one or more hooks for receiving the resilient elements. In yet another example, the displaceable band anchor 33 can be attached to, and removed from, the seat bracket 24 provided that once attached, the displaceable band anchor 33 does not move relative to the seat member 20. One or more of the displaceable band anchors 33 can be manipulated by the user to change its orientation, thereby changing the direction of resistance generated by the resistance elements.

The assembly 30 also includes one or more resistance elements, shown in FIGS. 1A to 1C as one or more resilient bands 35. Each resilient band 35 is an elastic member which undergoes elastic deformation. The resistance of each resilient band 35 to deformation is what generates the resistance required for the resistance exercises. Each resilient band 35 can be made from any suitable polymer material which undergoes elastic deformation. Each resilient band 35 may generate the same resistant load, or resilient bands 35 generating different resistant loads may be used. The resilient bands 35 may be coded, coloured, or otherwise marked to denote their different resistance values. For example, the resilient bands 35 may be colour-coded, where a given colour is indicative of a specific resistance or "weight". The resilient bands 35 may be similar to those described in PCT patent application having application number PCT/CA2017/050969 (published as WO 2018/032103) and filed Aug. 16, 2017, the entirety of which is hereby incorporated by reference.

Each resilient band 35 extends between, and is removably mountable to, the stationary and displaceable band anchors 31,33. Stated differently, each resilient band 35 links the band anchors 31,33 together. Therefore, when the seat member 20 is caused to displace in direction D along the base 16 by the user away from the stationary band anchor 31 (as shown in FIG. 1B), the distance between the seat member 20 and the stationary band anchor 31 increases. This causes each of the resilient bands 35 linking the stationary and displaceable band anchors 31,33 together to stretch, thereby generating resistance.

It can thus be appreciated that the resilient bands 35 allow the user to easily modify the resistance desired for training. For example, if the user wants to experience more resistance, such as for weight training, s/he may simply add more resilient bands 35 between the stationary and displacement band anchors 31,33. Similarly, if the user wants to experience less resistance, such as for cardiovascular training, s/he may simply remove one or more of the resilient bands 35, or change the resilient band 35 for one offering less resistance.

This is in contrast to certain prior art exercise devices, which require that free weights be added to a sliding mount. Such a technique for modifying the resistance is cumbersome because it requires manipulating relatively heavy weights. Furthermore, manipulating relatively heavy weights increases the risk that a weight might be dropped and cause injury, or impact someone while it is being displaced, or make an unpleasant and disruptive noise. There is also a limit to how much additional weight the device can support before experience structural stress and/or failure. Furthermore, such a technique for modifying the resistance requires that the user have different free weights available during training. Always having a suitable amount of free weights available for training is cumbersome, expensive, unlikely to occur, and reduces the portability of the exercise device.

In contrast, the resilient bands 35 disclosed herein, used in conjunction with the stationary and displaceable band anchors 31,33, allow the resistance of the unit 10 to be rapidly scaled up or down, without the above-described inconveniences and potential dangers associated with free weights.

The unit 10 allows reciprocal motion along its length, and is suitable for a rowing exercise, among other possible exercises. One possible resistance exercise with the unit 10 is now explained in greater detail with reference to FIGS. 1A and 1B.

One or more resilient bands 35 are mounted to, and extend between, the stationary band anchor 31 and the displaceable band anchor 33. The resilient bands 35 have a substantially horizontal orientation that is parallel with the seat member 20. A kick-off or foot pedal can be positioned near the unit 10 or mounted to the unit 10. For example, in the depicted embodiment, two kick-offs or pedals each extend horizontally outwardly from the base 16 at its first end 17A, and is transverse thereto. The kick-off or pedal provides a surface against which the user places their feet while seated on the seating portion 22 so as to simulate a rowing motion. The kick-off can also be a wall, or any other suitable surface against which the user can apply pressure to displace the seat member 20 along direction D away from the kick-off. A pulley and cable system having a handle can also be provided for use with the unit 10 to simulate rowing oars. The pulley and cable system can also be attached to the unit 10 and/or seat member 20. When the user displaces the seat member 20 along direction D toward the second end 17B of the base 16, as shown in FIG. 1B, the resilient band 35 is elastically deformed, thereby generating resistance that the user must overcome. At the end of the displacement, the resilient band 35 will generate a contraction force, which displaces the user and the seat member 20 along the direction D toward the first end 17A of the base 16. This contracting return movement offers relatively little resistance to the user. When no resistance exercise is being performed, the resilient band 35 is not elastically deformed as shown in FIG. 1A, and no resistance is generated.

Although shown and described herein as having a substantially horizontal orientation, the base 16 can have other orientations as well. For example, the base 16 can have a hinge which allows part of the base 16 to pivot.

Figure 2A:
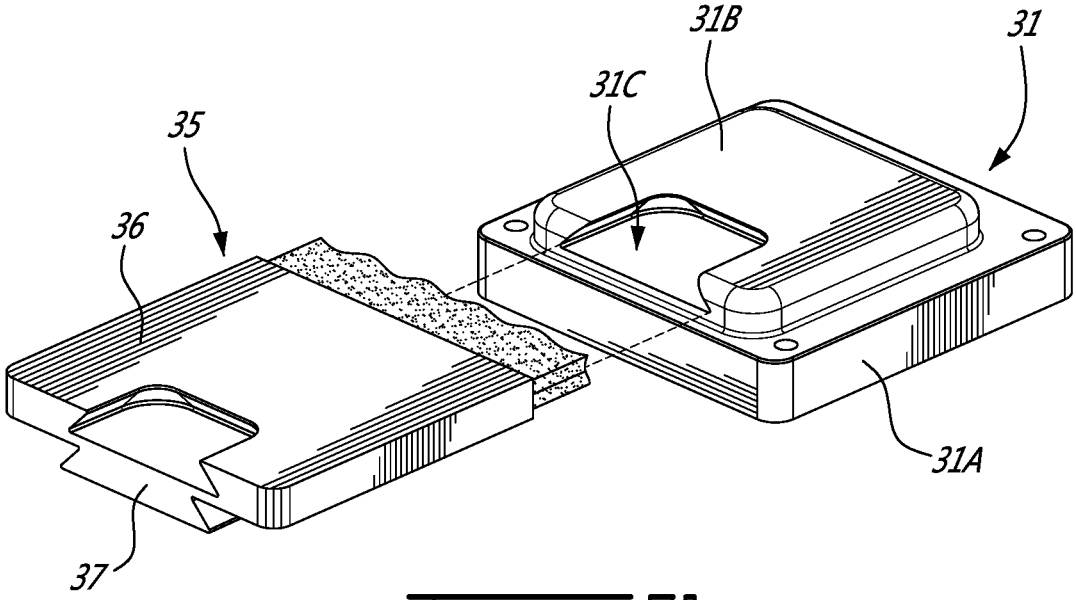
FIG. 2A is a disassembled perspective view of the resilient band and a band anchor of the seated exercise unit of FIG. 1A.
Figure 2B:
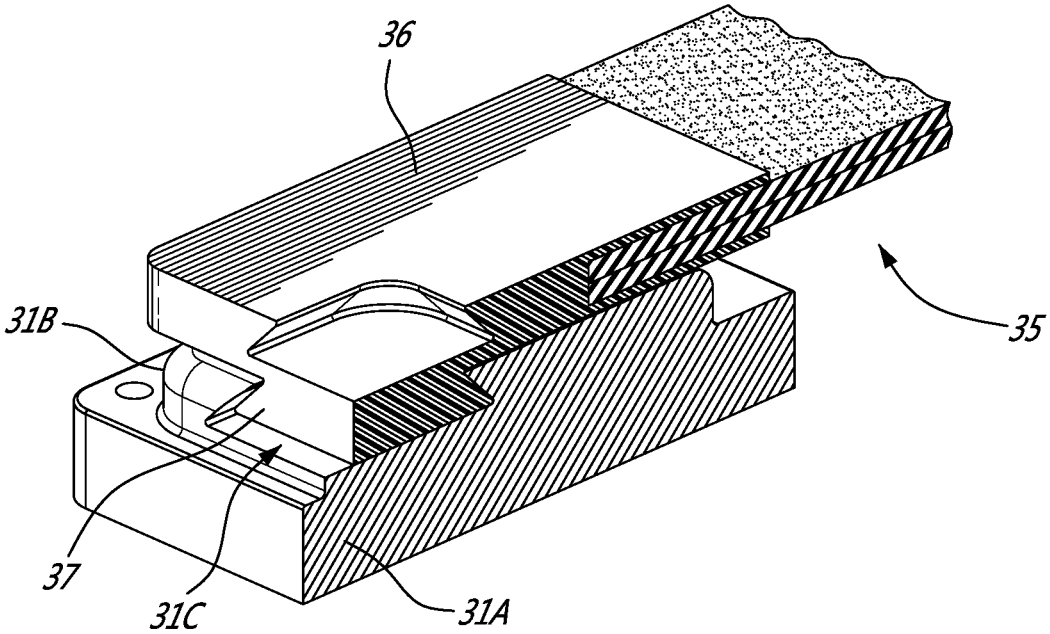
FIG. 2B is an assembled and partially-sectioned view of the resilient band and the band anchor of FIG. 2A.

The resilient bands 35 are located within the groove 16A. Since the groove 16A is accessible from above by the user, the resilient bands 35 are also accessible such that they can be removed or added by the user as desired. Referring to FIGS. 2A and 2B, each resilient band 35 has a mounting member 36 at one of its ends. Each mounting member 36 is a bracket which has a male connecting portion 37 which is removable insertable into the female receiving portion 31C of the bracket 31B of the stationary band anchor 31. The mounting member 36 at the other end of each resilient band 35 also has a male connecting portion, which is removable insertable into the female receiving portion of the bracket of the displaceable band anchor 33 (not shown in FIGS. 2A and 2B).

Figure 3:
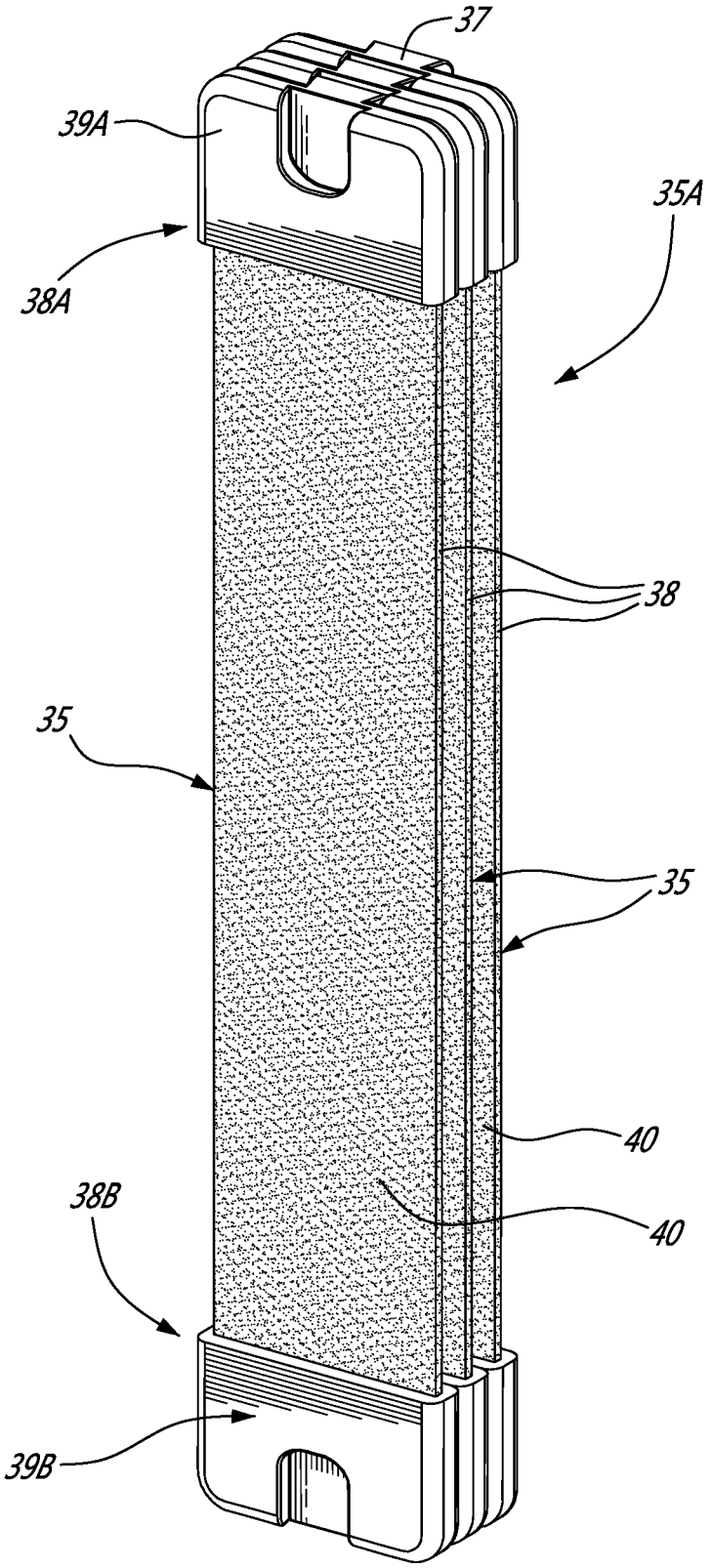
FIG. 3 shows a stack of resilient bands usable with the seated exercise unit of FIG. 1A.

Referring to FIG. 3, a plurality of the resilient bands 35 are stacked one on top of the other to form a stack of resilient bands 35A. The stack of resilient bands 35A generates a collective resistance that is greater than the resistance of each individual resilient band 35 when the stack of resilient bands 35A is elastically deformed by displacement of the displaceable band anchor 33 relative to the stationary band anchor 31. A first resilient band 35 (or lowermost resilient band 35, depending on the orientation of the stack of resilient bands 35A) in the stack of resilient bands 35A is removably mounted to the stationary and displaceable band anchors 31,33. Each of the resilient bands 35 remaining in the stack of resilient bands 35A is removably mounted to the resilient band 35 located immediately underneath, such that every resilient band 35 except for the first/lowermost one is stacked one on top of the other. Since the stationary and displaceable band anchors 31,33 are located in the groove 16B and aligned with the center line of the track 16A, the resilient bands 35 and the stack of resilient bands 35A are also centrally disposed in the groove 16B.

FIG. 3 shows one possible embodiment of the resilient band 35. Each resilient band 35 in the stack of resilient bands 35A has an elongated resilient body 38. The resilient body 38 (referred to herein sometimes simply as "body 38") is an object having a length, and extends between two opposed ends 38A,38B. The body 38 is elastically deformable and returns to its original form or configuration after being stretched. The resistance of the body 38 to deformation is what generates the resistance of the resilient band 35. The resiliency of the body 38 can be obtained from the material from which it is made. For example, the body 38 can be made from any suitable polymer material which undergoes elastic deformation. The material of the body 38 can be a naturally-occurring or synthetic elastomer, such as natural rubber, butyl rubber, or neoprene. In the depicted embodiment, the body 38 is in the form of a resilient band. The body 38 may take other forms as well. For example, the body 38 can be in the form of a resilient elongated cylinder, or can be in the form of a hollow resilient tube.

The resilient band 35 also has a first mounting member 39A and a second mounting member 39B. The first mounting member 39A is disposed at one of the ends 38A of the body 38, and the second mounting member 39B is disposed at the other end 38B of the body 38. Each of the first and second mounting members 39A,39B is a separate component from the body 38, and is attached or connected to their respective ends 38A,38B of the body 38, or integral therewith. In the depicted embodiment, the first and second mounting members 39A,39B are permanently attached to body 38. In an alternate embodiment, the first and second mounting members 39A,39B are removably mounted to the ends 38A,38B of the body 38.

For one of the resilient bands 35 shown, the first and second mounting members 39A,39B are also removably mounted to the stationary and displaceable band anchors 31,33, respectively. By mounting to the stationary and displaceable band anchors 31,33, the first and second mounting members 39A,39B link the body 38 to the relative displacement of the stationary and displaceable band anchors 31,33, thereby allowing the body 38 to generate resistance. The resilient body 38 therefore generates resistance upon being elastically deformed by the displacement of the second mounting member 39B mounted to the displaceable band anchor 33 relative to the first mounting member 39A mounted to the stationary band anchor 31. The relative displacement of the first and second mounting members 39A,39B occurs when the stationary and displaceable band anchors 31,33, to which they are attached, are displaced relative to one another.

The first and second mounting members 39A,39B are made of an inelastic material. In contrast to the body 38, which undergoes elastic deformation, the first and second mounting members 39A,39B are rigid and inflexible. Therefore, when the body 38 is undergoing elastic deformation, for example from tension being applied thereto, the first and second mounting members 39A,39B will not significantly expand or enlarge in shape. The non-elasticity or rigidity of the first and second mounting members 39A,39B allows the body 38 to be the principal generator of resistance in the resilient band 35. Some non-limiting examples of materials from which the first and second mounting members 39A, 39B can be made include plastic, wood, metal, rigid elastomers, and composites thereof. It will thus be appreciated that the material of the first and second mounting members 39A,39B is not the same as the elastomeric material of the body 38.

Still referring to FIG. 3, each of the resilient bands 35 has one or more visual indicia 40 which provides information to the user on the resistance provided by the resilient band 35. In the depicted embodiment, the visual indicia 40 is a colour that is unique to each resilient band 35, each colour being indicative of the stiffness of the body 38, or how much resistance it generates and "weight" it simulates. Other visual indicia 40, such as markings, alphanumeric characters, or symbols, may also be used to indicate resistance. In an alternative embodiment, the visual indicia 40 is provided on one of, or both, of the first and second mounting members 39A,39B. It can thus be appreciated that the user can select a resilient band 35 whose resistance is similar to that generated by a 10 lbs free weight, for example. The user can combine this resilient band 35 with another resilient band 35 whose colour is indicative of a resistance similar to that generated by a 20 lbs free weight, so as to form the stack of resilient bands 35A. The combined resistance of the stack of the resilient bands 35A will be similar to that generated by lifting 30 lbs of free weights.

Figure 4A:
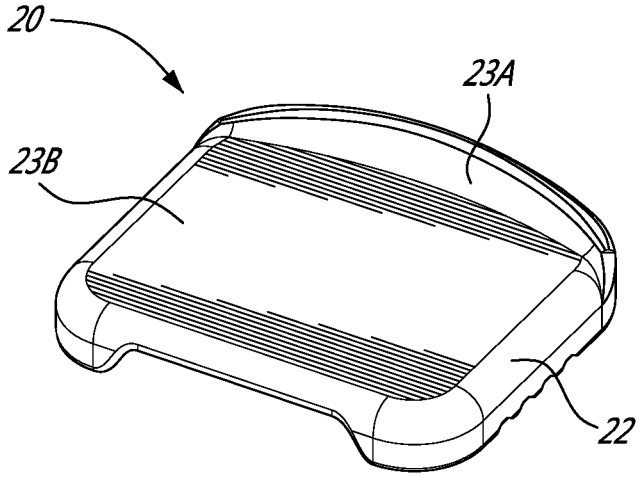
FIG. 4A is a perspective view of a seat member of the seated exercise unit of FIG. 1A.
Figure 4B:
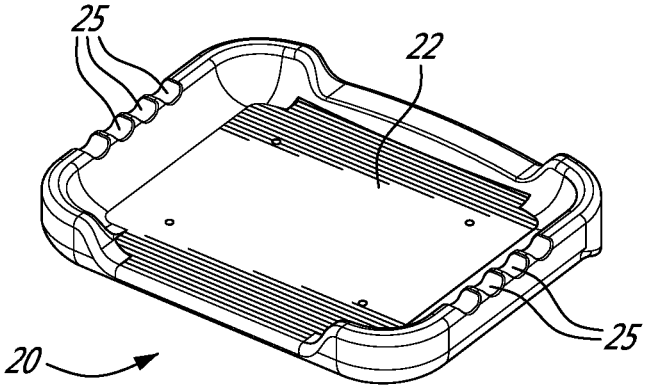
FIG. 4B is a perspective view of an underside of the seat member of FIG. 4A.
Figure 4C:
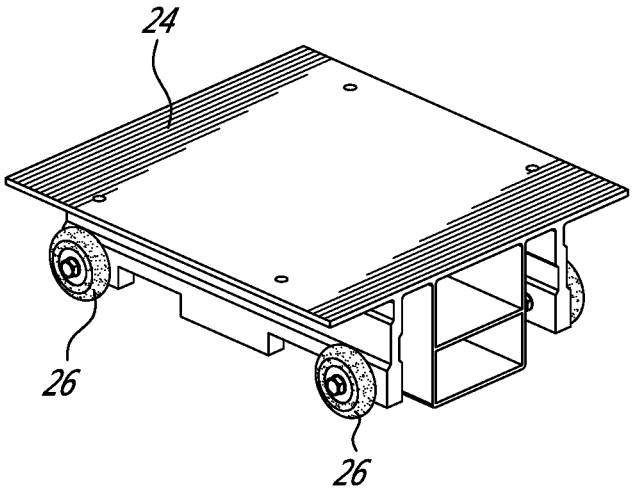
FIG. 4C is a perspective view of a seat bracket of the seat member of FIG. 4A.

FIGS. 4A to 4C show the seating portion 22 and the seat bracket 24 of the seating member 20. The seating portion 22 has a backrest portion 23A and a sitting portion 23B. The sitting portion 23B has finger grooves 25 formed on each side of the sitting portion 23B to allow the user to better grip the seating portion 22. The wheels 26 of the seating bracket 24 are also shown.

Figure 5:
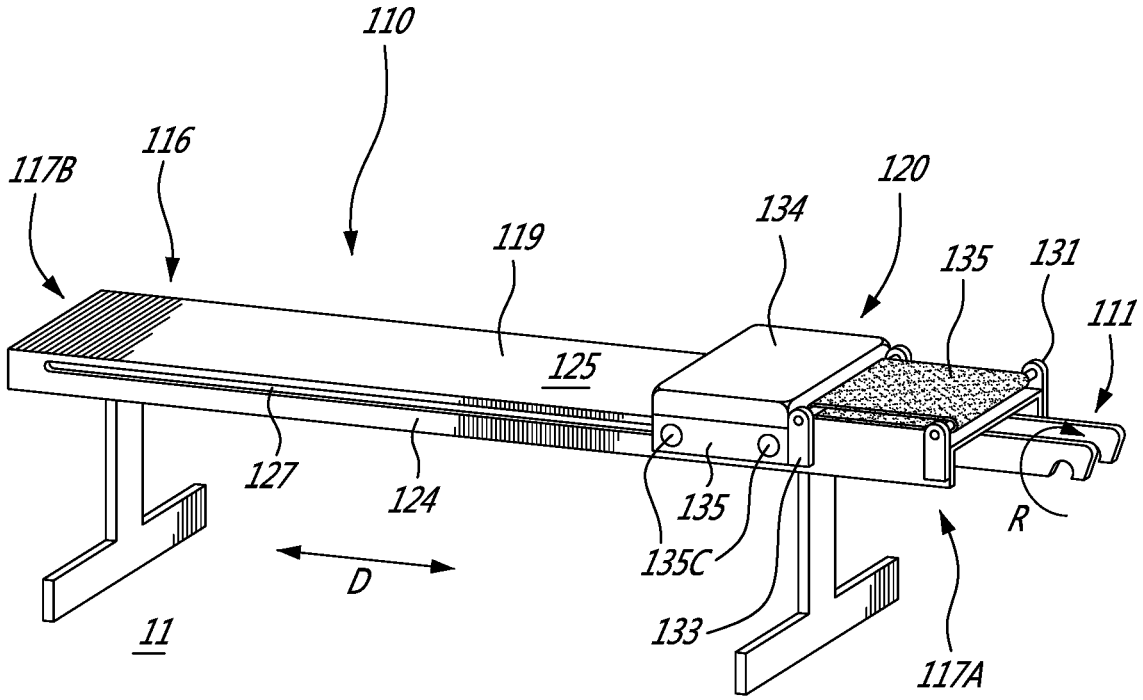
FIG. 5 is a perspective view of a seated exercise unit, according to another embodiment of the present disclosure.

Referring to FIG. 5, another embodiment of the unit 110 is shown. In the depicted embodiment, the base 116 has a planar upper portion 119 and a side portion 124 extending downwardly therefrom. The terms "upper" and "lower" refer to the base 116 when it has a horizontal orientation. As explained below, the base 116 can have a substantially vertical configuration, or it may be inclined relative to the floor surface 11. Therefore, it will be appreciated that the terms "upper" and "lower" are used solely to describe the depicted embodiment, and do not limit the base 116 and/or unit 10,110 to having only a horizontal orientation.

The upper portion 119 defines a seating surface 125 on which the user may directly sit when using the unit 110. The seating surface 125 may also receive therein padding or cushioning to provide comfort to the user. For example, one or more inflatable, padded, or foam cushions can be mounted to, and removed from, the seating surface 125. The cushions provide comfort and support to the user when s/he is sitting or lying on the base 116. One possible type of cushion which can be used is a BOSU™ seat. Each cushion can have any suitable fastener to easily attach the cushion to the corresponding slot or fastener of the seating surface 125.

In the depicted embodiment, the seat member 120 is used to simulate a rowing action. It includes a seating support 134 against which the user can sit. If desired, the seating support 134 can be padded, have cushions, or be made of a material that increases comfort when the user is sitting thereon. The seating support 134 can also have a backrest portion to support a back of the user. The base 116 has a slot 127 in the side portions 124 which supports the displacement of the seat member 120. A seat bracket 135 is attached to the seating support 134 and is used to removably attach the seating support 134 to the base 116 via the slot 127. The seat bracket 135 has wheels 135C for displacing the seat bracket 135, and thus the seating support 134, along the slot 127. The seat member 120 has a displaceable band anchor 133. The displaceable band anchor 133 is aligned with the stationary band anchor 131, which is secured to the base 116. The band anchors 131,133 lie in substantially the same horizontal plane. Other configurations for the seat member 120 are also possible and within the scope of the present disclosure, as described in greater detail below.

One possible resistance exercise with the unit 110 is now explained in greater detail with reference to FIG. 5. One resilient band 135 is mounted about and extends between the stationary band anchor 131 and the displaceable band anchor 133. The resilient band 135 has a substantially horizontal orientation that is parallel with the base 116. To simulate a rowing motion, the user applies pressure to displace the seat member 120 along direction D away from a kick-off. When the user displaces the seat member 120 along direction D toward the second end 117B of the base 116, the resilient band 135 is elastically deformed, thereby generating resistance that the user must overcome. At the end of the displacement, the resilient band 135 will generate a contraction force, which displaces the user and the seat member 120 along the direction D toward the first end 117A of the base 116.

Furthermore, the unit 110 has a pivot mounting member 111 at the first end 117A of the base 116. The mounting member 111 helps to secure the unit 110 to a corresponding object and allows the unit 110 to be rotated along direction R toward an upright orientation for storage. When the user wishes to use the unit 110, s/he can simply rotate it downward opposite to the direction R until it rests against the floor surface 11. Such pivoting functionality therefore allows the user to overcome space and mounting constraints associated with the specific location of the unit 110. The pivoting functionality can be achieved in many different ways. Although shown and described herein as having a substantially horizontal orientation, the base 116 can have other orientations as well. For example, the base 116 can have a hinge which allows part of the base 116 to pivot. It will be appreciated that the pivot mounting member 111 can also be used with the unit 10 described above, and with the unit 210 described below.

Figure 6:
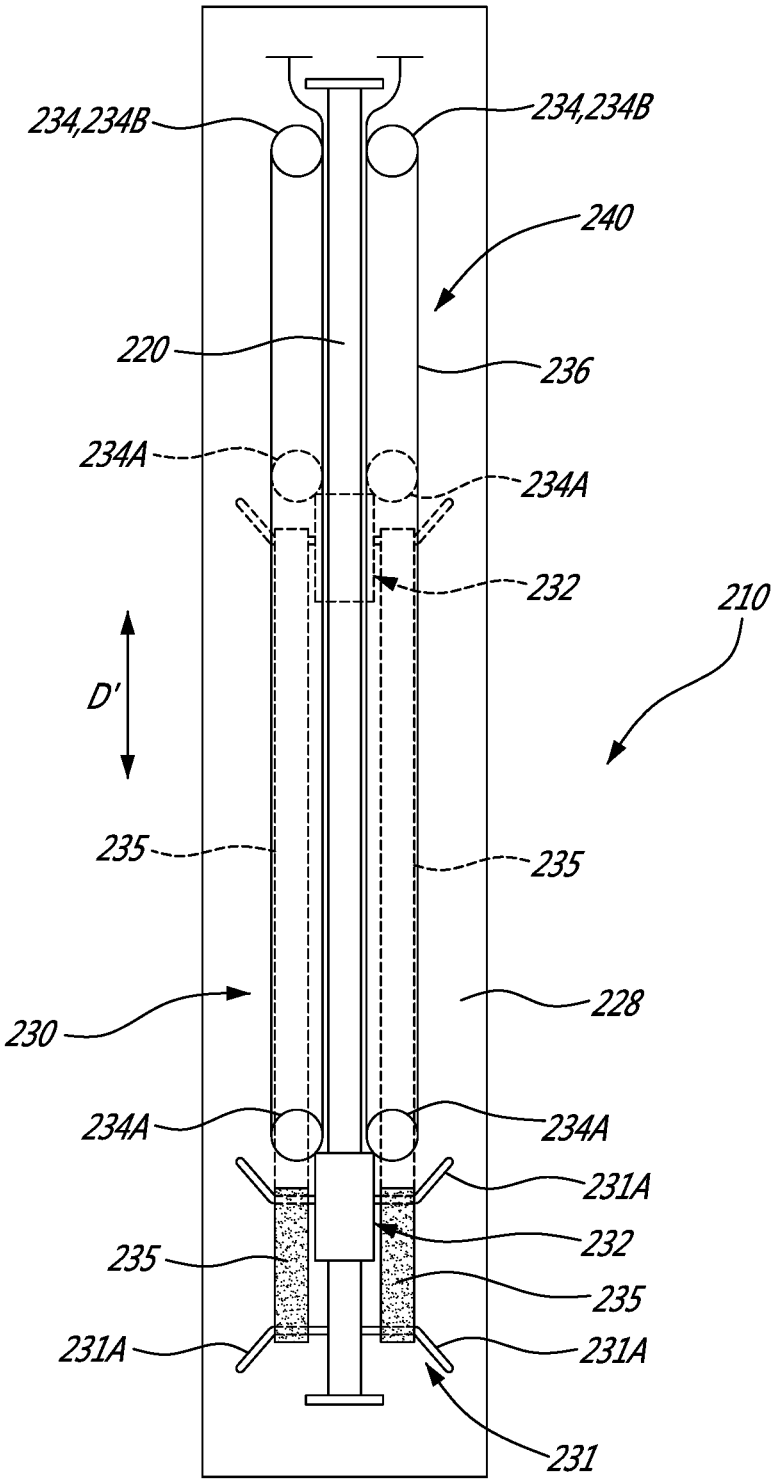
FIG. 6 is a perspective view of a seated exercise unit, according to yet another embodiment of the present disclosure.

Another embodiment of the seated exercise unit 210 is shown in FIG. 6. More particularly, an underside 228 of the unit 210, disposed opposite to the seating surface, has a different embodiment of the resistance-generating assembly 230. In the depicted embodiment, the resistance-generating assembly 230 has a displaceable member 232. The displaceable member 232 is mounted about the outer surface of a support tube 220 which is itself mounted to the underside 228 of the unit 210. The displaceable member 232 is displaceable along the support tube 220. More particularly, and as shown, the displaceable member 232 is slidingly displaceable along the support tube 220 in the direction D'.

The resistance-generating assembly 230 also has a stationary member 231 that is fixed in position, for example, to the support tube 220. The stationary member 231 is a fixed component, and is not displaceable relative to the support tube 220. It can therefore take any suitable form. In the embodiment of FIG. 6, the stationary member 231 includes one or more hooks 231A for receiving the resilient bands 235. Other configurations for the stationary member 231 are possible. For example, the stationary member 231 can simply be a protrusion or extension from the outer surface of the support tube 220 which is capable of receiving the resilient bands 235, and which is integral with the support tube 220.

The resistance-generating assembly 230 also includes a cable and pulley system 240 to displace the displaceable member 232 to generate the desired resistance. More particularly, the cable and pulley system 240 includes multiple pulleys 234 and a hand-operable cable 236. One or more of the pulleys 234A is positioned on the displaceable member 232 and is displaced with the displaceable member 232. As will be explained in greater detail below, the pulley 234A allows the displaceable member 232 to be displaced when the pulley 234A is moved by the cable 236. One or more of the remaining pulleys 234 are fixed in place, such as by being mounted to the support tube 220 or the unit 210, and are designated herein with reference number 234B. The fixed pulleys 234B remain fixed in position and do not undergo displacement.

The hand-operable cable 236 links the pulleys 234 to each other, and to the user via the seat member on the top of the unit 210 (not shown). The expression "hand-operable" refers to the cable 236 being pulled and moved by the actions of the user's hands, feet, or other body parts. As the seat member is displaced along the top of the unit 210, it draws on the hand-operable cable 236, which causes the displaceable member 232 to displace between an extended position (as shown in broken lines), and a neutral or retracted position (shown in solid lines). The user causes the displacement of the displaceable member 232, and thus generates the resistance required for the resistance exercises. The displaceable member 232 is displaceable relative to the stationary member 231 (i.e. towards and away from the stationary member 231), which allows the resilient band 235 to be used to generate resistance.

The one or more resilient bands 235 are mounted about the hooks 231A of the stationary and displaceable members 231,232. One end of the cable 236 is mounted to the displaceable member 232 via the pulleys 234A, while the other end is attached to the seat member. In this embodiment, as the user displaces the seat member, s/he draws on the cable 235. The arrangement of pulleys 234 and the cable 235 cause the displaceable member 232 to move away from the stationary member 231 along direction D'. This causes the resilient bands 235 to elastically deform, thereby generating the desired resistance.

The unit 210 can have more than one resistance-generating assembly 230. Each resistance generating assembly 230 can be spaced apart along the length of the unit 210, or they can side-by-side on the underside 228 of the unit 210.

Referring to FIGS. 1A to 1C, there is also disclosed a method of generating resistance. The method includes connecting one end of the resilient band 35 to a stationary first structure, such as the stationary band anchor 31. The method also includes connecting another end of the resilient band 35 to a displaceable seat member 20. The method includes displacing the seat member 20 relative to the stationary first structure to elastically deform the resilient band 35 to generate resistance.

Some or all of the components of the unit 10,110,210 can be dismantled and disassembled from one another for storage. Similarly, some or all of the components of the unit 10,110,210 can be folded to facilitate storage.

Although shown herein as being used for some specific exercises (e.g. rowing), the unit 10,110,210 can be used to perform other cardio-vascular or weight-training resistance exercises. Some non-limitative examples of other possible resistance exercises include leg extensions, leg curls, abdominal exercises, bench press, military, pec deck and overhead pulls. Some of the resistance exercises performed with the unit 10,110,210 may not require use of the seat member 20,120, which can therefore be removed. Therefore, the terms "seated", "seat", "seating", and their equivalents do not limit the unit 10,110,210 to being used by the user when s/he is only in a seated position. The unit 10,110,210 can be used to perform any exercise in which the user must cooperate with the unit 10,110,210, or is supported thereby. It will be appreciated that the unit 10,110,210 can also be used to perform purely cardiovascular exercises, or to for rehabilitation such as during physiotherapy.

In light of the preceding, it can be appreciated that the unit 10,110,210 disclosed herein, in at least some of its embodiments, is a resistance-based exercise unit 10,110,210 that is easily transportable, and easily stored. The unit 10,110,210 can be positioned in a vertical or horizontal orientation, or in any orientation therebetween. The unit 10,110,210 facilitates cardiovascular and/or weight-training exercises by allowing the user to easily increase the resistance of the bench by adding the relatively light-weight and easily-stored resilient bands 35,135,235.

The resilient bands 35,135,235 are both space and weight efficient. They are easy to transport, and thus facilitate transportability of the unit 10,110,210.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. A seated exercise unit, comprising:

a base configured to be supported by a floor and configured to be raised from the floor, the base extending between a first end and an opposed second end;

a seat member removably mounted to the base and displaceable therealong between the first and second ends of the base; and a resistance-generating assembly, comprising:

a stationary band anchor attached to the base;

a displaceable band anchor attached to the seat member, the displaceable band anchor being spaced apart from the stationary band anchor and displaceable with the seat member relative to the stationary band anchor; and resilient bands mountable to the stationary and displaceable band anchors and extending therebetween, the resilient bands being stackable one against the other to form a stack of resilient bands, the stack of resilient bands generating resistance upon the resilient bands in the stack of resilient bands being elastically deformed by displacement of the displaceable band anchor relative to the stationary band anchor.

2. The seated exercise unit as defined in claim 1, wherein a first of the resilient bands in the stack of resilient bands is removably mountable to the stationary and displaceable band anchors to extend therebetween, each of the other of the resilient bands in the stack of resilient bands being removably mountable to another one of the resilient bands in the stack of resilient bands.

3. The seated exercise unit as defined in claim 1 or 2, wherein the stationary and displaceable band anchors are disposed in a groove of the base.

4. The seated exercise unit as defined in claim 3, wherein the groove is disposed along a center line of the base.

5. The seated exercise unit as defined in claim 1 or 2, wherein the base comprises a mounting member at the first end thereof, the mounting member extending from the base to a distal end of the mounting member, the distal end of the mounting member defining a pivot.

6. The seated exercise unit as defined in claim 5, wherein the base is pivotable about the pivot to an upright orientation.

7. The seated exercise unit as defined in claim 1 or 2, wherein the base comprises at least one leg extending to the floor, a length of the at least one leg being adjustable.

8. The seated exercise unit as defined in claim 1 or 2, wherein the resilient bands generate a tension force upon being elastically deformed by displacement of the displaceable band anchor relative to the stationary band anchor in a first direction, and generate a contraction force acting in a second direction opposite to the first direction upon the resilient bands, in an elastically-deformed position, being released therefreom.

9. The seated exercise unit as defined in claim 1, wherein each of the resilient bands comprises a resilient body extending between opposed ends, a first mounting member attached to the resilient body at one of the opposed ends, and a second mounting member attached to the other end of the opposed ends, the first and second mounting members being made of an inelastic material, the first mounting member being removably mountable to the stationary band anchor and the second mounting member being removably mountable to the displaceable band anchor.

10. The seated exercise device as defined in claim 9, wherein at least one of the first mounting member, the second mounting member, and the resilient body comprise a visual indicia indicative of a resistance of each of the respective resilient bands.

11. The seated exercise unit as defined in claim 1, wherein a groove is defined by interconnected walls of the base, the interconnected walls comprising a bottom wall defining a floor of the groove.

12. The seated exercise unit as defined in claim 1, wherein the seat member comprises finger grooves for seizing the seat member.

13. A seated exercise unit, comprising:

a base configured to be supported by a floor and configured to be raised from the floor, the base having a track with a groove extending along a length of the track between a first end and an opposed second end of the base;

a seat member having a seating portion and a seat bracket positioned on an underside of the seating portion, the seat bracket displaceably mounted in the groove of the track to displace the seating portion relative to the track along the length thereof; and a resistance-generating assembly, comprising:

a stationary band anchor attached to the track;

a displaceable band anchor attached to the seating portion or to the seat bracket, the displaceable band anchor being displaceable with the seating portion and relative to the stationary band anchor; and resilient bands positionable within the groove of the track and removably mountable to the stationary and displaceable band anchors and extending therebetween, the resilient bands being stackable one against the other within the groove to form a stack of resilient bands, the stack of resilient bands generating resistance upon being elastically deformed by displacement of the displaceable band anchor relative to the stationary band anchor.

14. The seated exercise unit as defined in claim 13, wherein a lowermost of the resilient bands in the stack of resilient bands is removably mountable to the stationary and displaceable band anchors to extend therebetween, each of the other resilient bands in the stack of resilient bands being removably mounted to the respective one of the resilient bands in the stack of resilient bands disposed immediately underneath.

15. The seated exercise unit as defined in claim 13 or 14, wherein the stationary and displaceable band anchors are disposed in the groove of the track.

16. The seated exercise unit as defined in claim 3 or 14, wherein the groove is disposed along a center line of the track.

17. The seated exercise unit as defined in claim 3 or 14, wherein the base comprises at least one leg extending to the floor, a length of the at least one leg being adjustable.

18. The seated exercise unit as defined in any one of claims 13 to 14, wherein the base comprises a mounting member at the first end thereof, the mounting member extending from the base to a distal end of the mounting member, the distal end of the mounting member defining a pivot.

19. The seated exercise unit as defined in claim 13, wherein each of the resilient bands comprises a resilient body extending between opposed ends, a first mounting member attached to the resilient body at one of the opposed ends, and a second mounting member attached to the other end of the opposed ends, the first and second mounting members being made of an inelastic material, the first mounting member being removably mountable to the stationary band anchor and the second mounting member being removably mountable to the displaceable band anchor.

20. The seated exercise device as defined in claim 19, wherein at least one of the first mounting member, the second mounting member, and the resilient body comprise a visual indicia indicative of a resistance of each of the respective resilient bands.

21. The seated exercise unit as defined in claim 13, wherein the resilient bands generate a tension force upon being elastically deformed by displacement of the displaceable band anchor relative to the stationary band anchor in a first direction, and generate a contraction force acting in a second direction opposite to the first direction upon the resilient bands, in an elastically-deformed position, being released therefreom.

22. The seated exercise unit as defined in claim 13, wherein the groove is defined by interconnected walls of the track, the interconnected walls comprising a bottom wall defining a floor of the groove.

23. The seated exercise unit as defined in claim 13, wherein the seating portion comprises finger grooves for seizing the seating portion.

24. The seated exercise unit as defined in claim 13, wherein the base is pivotable about a pivot to an upright orientation.

* * * * *